US006289615B1

(12) United States Patent
Kytlica

(10) Patent No.: US 6,289,615 B1
(45) Date of Patent: Sep. 18, 2001

(54) CALENDAR WITH REFILLABLE SLEEVES

(76) Inventor: Heike Kytlica, 8113 Shadyglade Ave., North Hollywood, CA (US) 91605

( * ) Notice: Subject to any disclaimer, the term of this patent is extended or adjusted under 35 U.S.C. 154(b) by 0 days.

(21) Appl. No.: 09/440,673

(22) Filed: Nov. 16, 1999

Related U.S. Application Data

(60) Provisional application No. 60/109,069, filed on Nov. 18, 1998.

(51) Int. Cl.[7] ..... G09D 3/04; A47G 1/06

(52) U.S. Cl. ..... 40/119; 40/122; 40/776; 283/2

(58) Field of Search ..... 40/107, 119, 122, 40/124.2, 537, 776; 283/2, 117

(56) References Cited

U.S. PATENT DOCUMENTS

| | | | | |
|---|---|---|---|---|
| 171,308 | | 12/1875 | O'Neill . | |
| 590,765 | | 9/1897 | Miller . | |
| 826,658 | | 7/1906 | Gerow . | |
| 1,004,158 | | 9/1911 | Fowler . | |
| 1,487,520 | | 3/1924 | Ringler . | |
| 2,213,920 | * | 9/1940 | Murray | 40/107 X |
| 3,270,449 | * | 9/1966 | Robbie | 40/537 |
| 4,201,405 | | 5/1980 | Rannenberg . | |
| 5,195,262 | * | 3/1993 | Roane | 40/119 X |
| 5,426,876 | | 6/1995 | Jagoe et al. | 40/119 |
| 5,661,918 | | 9/1997 | Malcolm et al. | 40/107 |
| 5,715,618 | | 2/1998 | Whang | 40/119 |
| 5,893,229 | * | 4/1999 | Werner | 40/760 X |
| 5,918,394 | * | 7/1999 | Babcock | 40/122 |

FOREIGN PATENT DOCUMENTS

| | | |
|---|---|---|
| 0171490 | 12/1991 | (EP) . |
| 2037023 | 7/1980 | (GB) . |
| 9104917 | 4/1991 | (WO) . |

* cited by examiner

*Primary Examiner*—Brian K. Green
(74) *Attorney, Agent, or Firm*—Richard C. Litman

(57) ABSTRACT

A refillable combination calendar and photo album device for selectively displaying particular calendrical time periods and personal memorabilia, concurrently. The combination calendar and photo album apparatus is defined by at least twelve transparent sleeves, each having an upper edge, a lower edge, and two side edges. Each of the transparent sleeves are rotatably bound together along the upper edge thereof enabling any one of the transparent sleeves to be displayed in front of the other sleeves. Included in the combination calendar and photo album apparatus are at least twelve calendar display inserts for selectively displaying at least twelve different calendrical time periods. A photo album page is placed behind the calendar insert for showing personal photographs, etc. Formed in each transparent sleeve near the lower edge is a hole, an adhesive tab or a magnetic tab for enabling the combination calendar and photo album apparatus to be suspended from a wall or similar structure.

6 Claims, 2 Drawing Sheets

CALENDAR WITH REFILLABLE SLEEVES

CROSS-REFERENCE TO RELATED APPLICATION

This application claims the benefit of U.S. Provisional Patent Application Ser. No. 60/109,069, filed Nov. 18, 1998.

BACKGROUND OF THE INVENTION

1. Field of the Invention

The present invention relates generally to display type calendars and more specifically, to calendars provided with refillable transparent sleeves for displaying personalized photographs, pictures, and the like.

2. Description of Related Art

Pictures are often displayed with calendars to make the calendars more attractive. Sometimes a single picture may be used for the entire year with tear-off calendar sheets. Usually calendars display a new picture each month. With such calendars, one, of course, is limited to the particular pictures selected by the manufacturer of the calendar.

To overcome this disadvantage, and to enable one to display the work of their choosing, several inventions have been devised, as typified by U.S. Pat. No. 715,479 issued to F. E. Housh. Housh discloses a frame and calendar with a backing and a mat affixed thereto for displaying a selected picture, advertising devise, or other printed material. U.S. Pat. No. 5,426,876 issued to Jagoe et al. on Jun. 27, 1995 discloses a calendar photo album having a pad of assembled sheets suitably mounted to turn as leaves and presenting pairs of opposed pages, one of the pages of each pair bearing a calendar page of a different month of the year, and the other page of each pair bearing a picture holding member for displaying photos and the like. U.S. Pat. No. 5,715,618 issued to Whang on Feb. 10, 1998 discloses a biennial photo album having at least twelve calendar pages that are bound and supported by a stand. Each calendar page has a photo holding member and a calendar section on the same page. U.S. Pat. No. 5,661,918 issued to Malcolm et al. on Sep. 2, 1997 discloses a combination desk top calendar and picture frame which allows a user to insert his or her picture or photo of choice into the front cover of the calendar. A plurality of calendar pages are held inside the front cover. Other relevant disclosures are those of W. A. Ringler, U.S. Pat. No. 1,487,520; Rannenberg, U.S. Pat. No. 4,201,405; and Rohloff, Foreign Pat. No. WO/04917.

Problems common among previously existing photo-calendar devices include an inability to refill a photo-calendar device with new calendar displays device; an inability to selectively refill a photo-calendar device with new photographs and calendar displays, and an absence of means for suspending a photo-calendar device from a wall or other vertical structure.

None of the above inventions and patents, taken either singly or in combination, is seen to describe the instant invention as claimed. Therefore, a refillable calendar solving the aforementioned problems is desired.

SUMMARY OF THE INVENTION

The present invention is a refillable combination calendar and photo album apparatus for selectively displaying particular dates and photographs concurrently. The combination calendar and photo album apparatus is defined by at least twelve transparent sleeves, each having an upper edge, a lower edge, and two side edges. The apparatus is further defined by each of the transparent sleeves being bound together along the upper edge attaching each of the sleeves together. The apparatus is further defined by at least twelve calendar display inserts for selectively displaying at least twelve different calendar time periods. Formed in each transparent sleeve near the lower edge is a suspension means for enabling the combination calendar and photo album apparatus to be suspended from a wall or similar structure.

Accordingly, it is a principal object of the invention to provide a combination calendar and photo album apparatus capable of being selectively refilled with new calendar displays and photographic displays.

It is another object of the invention to provide a combination calendar and photo album apparatus having a plurality of transparent sleeves and a corresponding number of calendar inserts for selective insertion of the calendar inserts into the sleeves.

It is a further object of the invention to provide a combination calendar and photo album apparatus having a suspension means formed therein for suspending the apparatus from a wall or similar structure.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
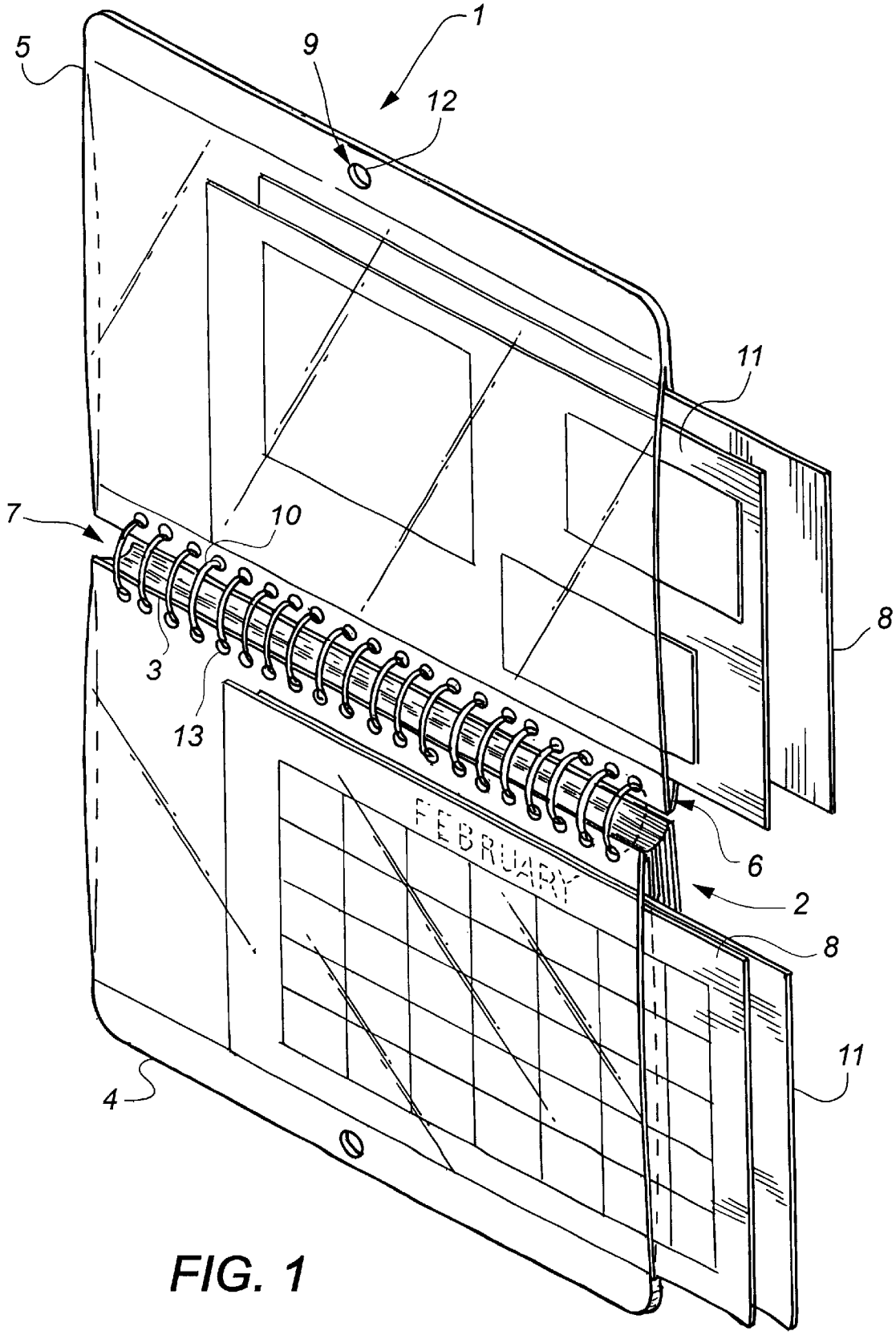
FIG. 1 is a perspective view of a refillable calendar according to a first embodiment of the present invention.
Figure 2:
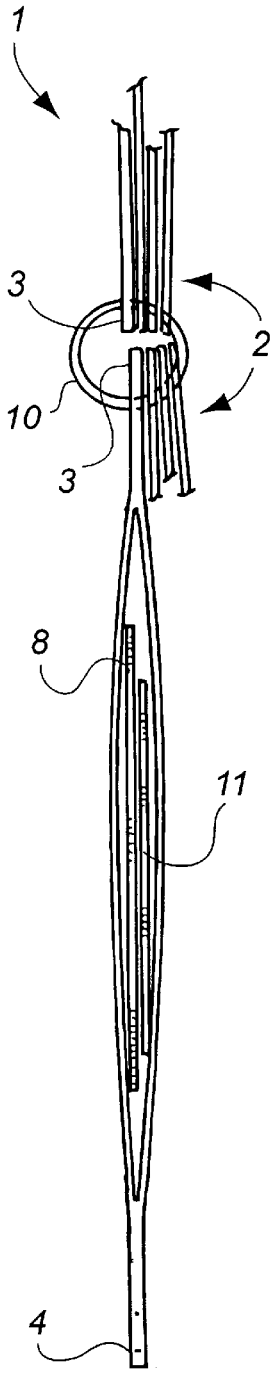
FIG. 2 is a partial, elevational side view of a refillable calendar according to the first embodiment.

Shown in FIGS. 1 and 2 is a combination calendar and photo album apparatus 1 according to a first preferred embodiment. The combination calendar and photo album apparatus 1 is defined by at least twelve transparent sleeves 2 attached together at one end by a binding means 7. Each transparent sleeve 2 is identical and is defined by an upper edge 3, a lower edge 4, and two parallel sides at opposing ends thereof. Preferably, the transparent sleeves 2 are made of plastic material and are rotatively attached together by a spiral wire 10 as a binding means 7. According to a preferred embodiment, formed in each transparent sleeve 2 along the upper edge 3 are a plurality of holes 13 for receiving a spiral wire 10 therethrough. Inserted through each of the plurality of holes 13 of each sleeve 2 is the spiral wire 10 for rotatively attaching together each of the transparent sleeves 2.

Formed at each of the two parallel sides 5 is a slit opening 6 for receiving a calendar insert and memorabilia insert. Formed in each transparent sleeve 2 near the lower edge 4 is a suspension means 9 for enabling the transparent sleeves to be suspended from a wall. FIG. 1 illustrates a first embodiment of the suspension means 9 where the suspension means 9 is a hole 12 formed in each of the transparent sleeves 2 for permitting the combination calendar and photo album apparatus to be suspended from a conventional nail attached to a wall. A second and third preferred embodiment of the suspension means 9 will be described later with reference to FIGS. 3 and 4.

The invention is further defined by at least twelve calendar inserts 8 for displaying calendar dates from at least twelve different time periods on one side of each. Each calendar insert 8 is sized marginally less than the size of each slit opening 6 for enabling one calendar insert to slide easily in each slit opening 6. Inserted in each slit opening 6 of the transparent sleeves 2 is only one calendar insert 8 so that a particular time period may be displayed through one side of a transparent sleeve 2 while a page 11 from a photo album may be displayed through an opposing side thereof.

Figure 3:
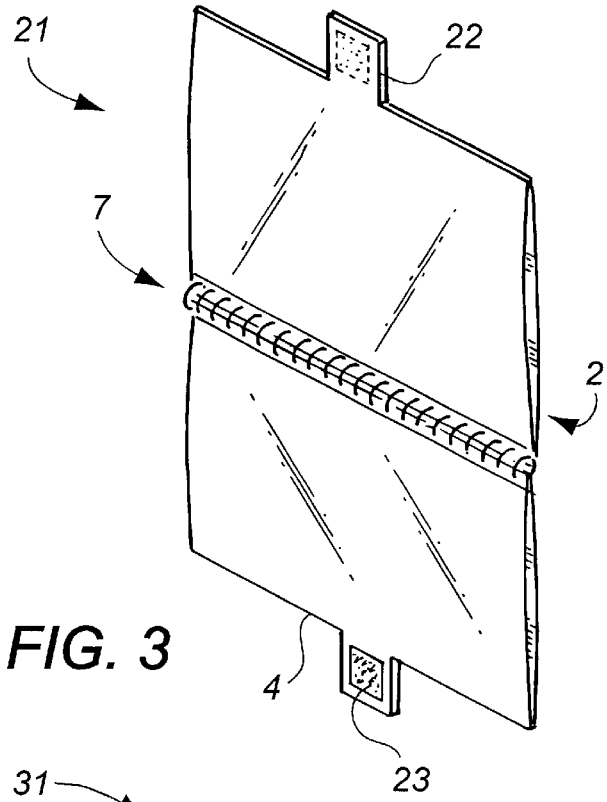
FIG. 3 is a perspective view of a refillable calendar according to a second embodiment.

Shown in FIG. 3 is a perspective view of a refillable combination calendar and photo album apparatus 21 according to a second preferred embodiment. The combination calendar and photo album apparatus 21 of the second embodiment is identical in every respect to the calendar and photo album apparatus 1 of the first embodiment except for the suspension means.

Details relating to the suspension means 9 according to the second preferred embodiment will now be described. Formed in each of the transparent sleeves 2 at the midpoint of the lower edge 4 is a tab 22. Adhesively attached to the tab 22 is a conventional adhesive material 23 for enabling the combination calendar and photo album apparatus 21 to be adhesively suspended from a wall.

Figure 4:
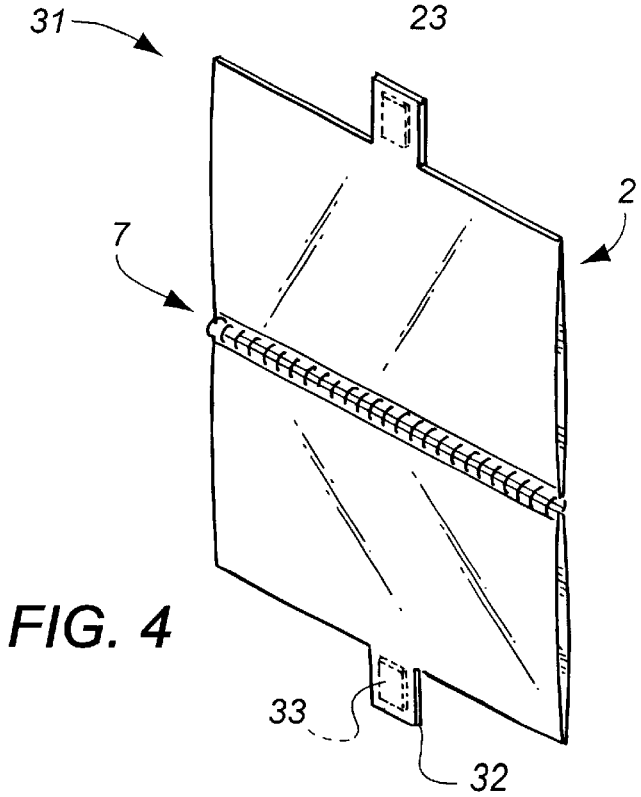
FIG. 4 is a perspective view of a refillable calendar according to a third embodiment.

Shown in FIG. 4 is a combination calendar and photo album apparatus 31 according to a third preferred embodiment. The calendar and photo album apparatus 31 is identical in every respect to the apparatus defined for the first preferred embodiment except the suspension means 9. Formed in each of the transparent sleeves 2 at the midpoint of the lower edge 4 is a tab 32. Contained inside each tab 32 is a conventional, thin magnet 33 enabling the combination calendar and photo album apparatus to be magnetically suspended from vertical metal structure, such as a conventional refrigerator.

It is to be understood that the present invention is not limited to the sole embodiments described above, but encompasses any and all embodiments within the scope of the following claims.

I claim:

1. A refillable calendar/photo album apparatus comprising:

at least 12 transparent sleeves, each defined by a first side, a second side, an upper edge, a lower edge, and two parallel side edges, each of the two side edges defining a slit opening;

at least 12 calendar inserts, each removably and separately inserted in one of said at least 12 transparent sleeves for removably displaying selected dates of a year through the first side;

at least 12 memorabilia inserts, each removably and separately inserted in one of said at least 12 transparent sleeves for removably displaying personalized photographs through the second side;

a binding means attached to said upper edge of each transparent sleeve for rotatably attaching each of said at least 12 transparent sleeves together; and a suspension means formed at a midpoint in each of said at least 12 transparent sleeves along said lower edge for enabling said transparent sleeves to be suspended from a vertical surface.

2. The refillable calendar/photo album apparatus recited in claim 1, wherein said binding means is a spiral wire.

3. The refillable calendar/photo album apparatus recited in claim 1, wherein said suspension means is a hole formed in each of said transparent sleeves.

4. The refillable calendar/photo album apparatus recited in claim 1, wherein said suspension means comprises:

a tab formed at the midpoint of the lower edge and conventional adhesive material adhesively attached to said tab for enabling the refillable calendar/photo album apparatus to be adhesively suspended from a wall.

5. The refillable calendar/photo album apparatus recited in claim 1, wherein said suspension means comprises:

a tab formed at the midpoint of the lower edge and a thin magnet formed inside of said tab for enabling the refillable calendar/photo album apparatus to be magnetically suspended from a vertical metal structure.

6. The refillable calendar/photo album apparatus recited in claim 1, wherein each of said at least 12 transparent sleeves is made of a plastic material.

* * * * *